United States Patent [19]

Antepenko

[11] 3,952,961

[45] Apr. 27, 1976

[54] STRAP DISPENSING METHOD AND APPARATUS

[75] Inventor: Robert F. Antepenko, Northlake, Ill.

[73] Assignee: Signode Corporation, Glenview, Ill.

[22] Filed: Mar. 11, 1974

[21] Appl. No.: 449,924

[52] U.S. Cl. ..... 242/54 R; 242/78.6; 242/105

[51] Int. Cl.[2] ..... B65H 75/32; B65H 17/52

[58] Field of Search ..... 242/54 R, 67.4, 77, 242/105, 78.6

[56] References Cited

UNITED STATES PATENTS

| | | | |
|---|---|---|---|
| 2,664,250 | 12/1953 | Friedman | 242/54 R |
| 3,081,957 | 3/1963 | Van De Bilt | 242/54 R |
| 3,162,394 | 12/1964 | Culpepper | 242/105 X |
| 3,717,313 | 2/1973 | Williams | 242/54 R |

*Primary Examiner*—Edward J. McCarthy
*Attorney, Agent, or Firm*—Dressler, Goldsmith, Clement & Gordon, Ltd.

[57] ABSTRACT

A strap dispenser is mounted for vertical movement on a frame from an elevated rest position to a strap dispensing position therebelow. The dispenser includes a coil of strap that is clamped by a hub, and upon demand for strap, the hub is permitted to fall from the rest position to transform the potential energy of the strap coil to rotational energy through a one-way clutch, which overcomes the inertia of the strap coil and initiates its rotation. When the demand for strap ceases, a mechanism is actuated in response thereto for positively holding the hub against rotation with respect to the shaft, and the inertia of the formerly rotating coil is utilized to return the hub mechanism to a rest position.

34 Claims, 20 Drawing Figures

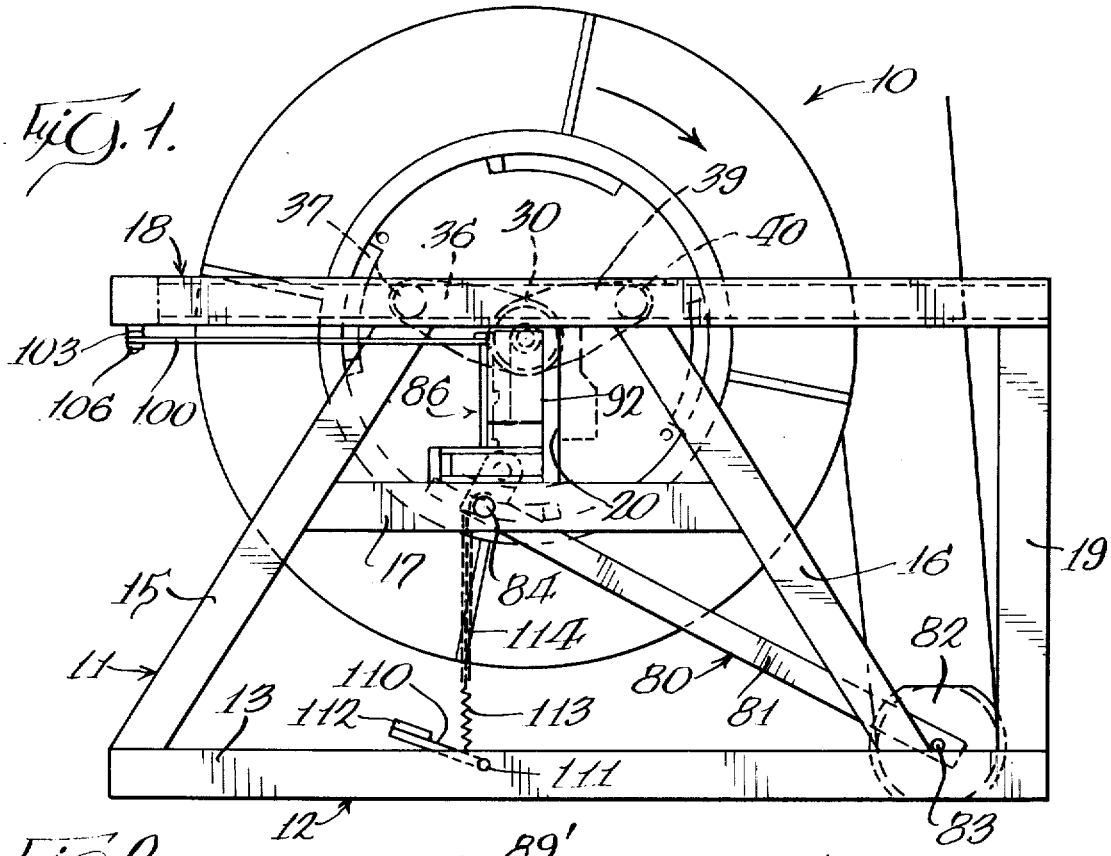
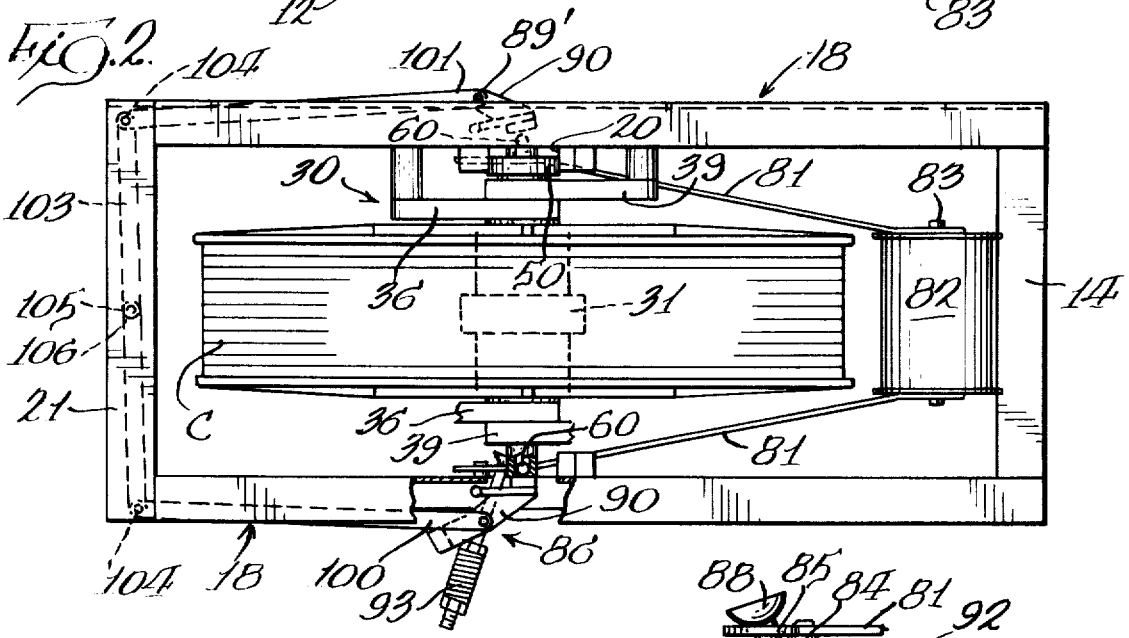
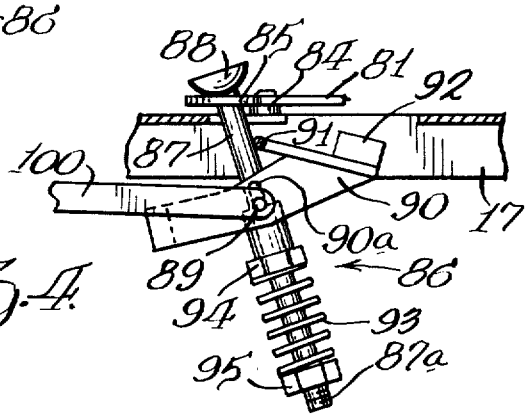
Fig. 4.

133
162b
132
132a
130
162a
157
137
141
136
14
138
135
137
156
135
154
160
138
155
132a
137
136
131
180
144
158
32b
14
139
143
139
150
180
144
131a
155
131
137
135
137
160
135
136
138
160
156
138
154
181
136
137
162a
132a
162b
133

19.
20.
20
20a
92
50
210
211
212
213
214
214
216
230
240
241
242
243
244
245
250
251
252
253
253a
254
255
256
260
261
270
270a
270b
270c
280
282
283
285
286
287
287a
288
289
290
295
295a
295b
295c
301
301a
302
305
310
310a
311
311a
311b
312
312'
300
81
84
906
236
237

STRAP DISPENSING METHOD AND APPARATUS

BACKGROUND OF THE INVENTION

The present invention relates to a new and improved strap dispenser, particularly a dispenser in which strap is supplied in coils of substantial weight, wherein the weight of the coil is used to initiate and terminate dispensing with minimal shock loads to the dispenser and without strap overrun.

It has been found that the mass and inertia of strap coils, particularly when they are fresh and have relatively great weight, produce a large shock load on the strap feeding mechanism of the strapping machine when dispensing is terminated. This is due to the stopping mechanisms of the prior art, which must absorb the large rotational energy of the rotating coil to terminate its rotation.

Another problem associated with prior art strap dispensers is that rotational inertia will cause the strap from these coils to overrun when the feed to the strapping machine has been terminated, unless the rotation is very quickly terminated. This overrunning can leave a substantial length of strap lying loose between the coil and the feed mechanism of the strapping machine, which can cause tangling and which increases the opportunity for snagging of the strap when feed is again commenced.

Various apparatus has been suggested in the past for dispensing strap in an effort to meet the above mentioned problems, and representative prior art patents are discussed herebelow. For various reasons these apparatus are not particularly suitable for large mass coils.

Forbes U.S. Pat. No. 1,144,831, discloses a tubular feeding slide to prevent the coil from opening during dispensing, but does not disclose any means for solving the overrunning and stopping problems. In Porter U.S. Pat. No. 2,155,771, circumferential ring springs are disclosed to provide a continuous braking action to prevent overrunning of the strap. However, such continuous braking inhibits the dispensing of strap and produces excessive wear on the brake elements. These disadvantages were recognized in Green U.S. Pat. No. 2,506,554, which discloses a rim riding rotating feeder brake which reduced, if not substantially eliminated, braking during the dispensing operation. However, the Green brake has little applicability to large mass coil dispensers which generate high rotational energy. Coils were eventually power fed as in Leslie U.S. Pat. No. 2,779,410, in which the strapping was drawn from the center of the coil, and back pressure on the feed was used to prevent overrunning.

SUMMARY OF THE INVENTION

The improved strapping dispenser comprising the present invention has been designed for use primarily in connection with the dispensing of continuous steel strapping at a station where it is caused to encircle an object to produce a loop, which is then tensioned about the object by a power operated strapping machine preparatory to adjoining the strap ends and severing the trailing end of the strap to free the strapped object from the strapping machine.

The strapping dispenser is of the reel type, which is to say that the coil of strap which is wound in involute fashion is mounted upon a rotatable hub which, itself, is axle mounted. The hub and coil, in effect, constitute a rotatable spool from which the strapping material is pulled in tangential fashion, as required, thus causing spool rotation during actual strap feeding operations.

The present invention utilizes the mass of the coil (up to 1,000 lbs. and even larger) to initiate rotation; as the coil is allowed to fall, by changing the potential energy of the coil into rotational energy. Strap dispensing is terminated as a result of the coil mass, by locking the coil from rotation and converting its rotational energy into a vertical force thereby lifting the coil and dissipating its energy. In this manner, overrunning of strap is eliminated and shock loads to the dispenser are minimal.

The axle on which the hub of the coil of strap is mounted includes separate inner and outer coaxial axles, each axle being located relative to and supported from a frame by support arms, which have one end fixedly connected at right angles to their respective axles. The other ends of the support arms are movably supported in horizontal guide tracks of the frame, and horizontal movement of these ends of the arms results in raising and lowering the spool. The axles are constrained to move in a vertical guide channel of the frame to assure that the spool moves in the vertical direction as the frame mounted ends of the support arms move in the horizontal direction.

A one-way clutch mechanism is connected between the hub and the outer axle to assist in retaining the spool in the rest position, and to initiate rotation of the spool when demand for strap occurs. A key mechanism is provided for selectively connecting the inner axle to the hub to terminate spool rotation causing the rotational energy of the spool to lift itself. The key mechanism also assists in retaining the spool in the rest position. A dancer arm assembly is provided to sense strap tension, and a coupling mechanism is actuated by the dancer arm assembly to engage and disengage the key mechanism.

Prior to commencement of dispensing, the spool is positioned at an elevated position relative to the frame and supported by the arms, which are approximately horizontal in this position, through the key mechanism, and the one-way clutch. As strap is required, the coupling mechanism is actuated to disengage the key mechanism, and the spool falls vertically, while the support arms pivot downwardly and the frame mounted ends of the support arms move toward one another in the horizontal guide track. As the spool falls, the one-way clutch remains engaged and rotation of the spool is initiated as the support arms pivot. After the support arms have moved together and the spool has reached the strap feeding position, the spool over-runs the clutch and dispensing of strap commences.

Intermediate braking is provided by a brake actuated by the dancer arm as demand for strap fluctuates. When demand ceases, the keys are actuated, locking the spool to the inner axle and the arms connected thereto. The rotational energy of the spool causes the spool supporting arms to pivot about the point of contact with the horizontal guide tracks thus causing the spool to rise vertically, dissipating its energy in the form of work. As the spool rises, the support arms are pivoted upwardly. After the spool has reached equilibrium, it is again supported in the upper vertical position on the arms through the key mechanism and clutch. Thus, through the use of the stored potential energy and rotational energy in operating the dispenser, the dispensing mechanism of this invention substantially eliminates shock loading and strap overrun while providing quick response to strap demand.

Strap coils are machine wound and consequently are of varying inner and outer diameters and width. In order to compensate for various size inner diameters and to facilitate mounting of the coil of strap, a novel mounting mechanism is also disclosed. This mechanism provides for the acceptance of coils of a variety of inner diameters and widths, yet is adapted to securely mount the coil to the hub to assure conjoint rotation therewith. The coil mounting mechanism includes a plurality of radially movable members, which are attached to the hub by two bar linkages, one link attached to the radial member, the other to the hub. The links are pivotally connected at corresponding ends and are operated by transversely movable spools which move the members radially. The spools for each radial member are operatively connected, so that the radial members may be moved inwardly and outwardly conjointly for mounting the coil of strap. The mounting means includes a movable side plate which, when a coil is mounted, applies a side force to the coil to prevent axial movement thereof.

BRIEF DESCRIPTION OF THE DRAWINGS

FIG. 1 is a side elevation view of a strapping dispenser embodying the principles of the present invention and showing the same in its position of rest;

FIG. 2 is a top plan view of the strapping dispenser of FIG. 1, with certain portions broken away for clarity of illustration;

FIG. 4 is a fragmentary plan view of an overcenter mechanism that is used to control rotation of the dispenser spool;

DESCRIPTION OF THE PREFERRED EMBODIMENT

Figure 3:
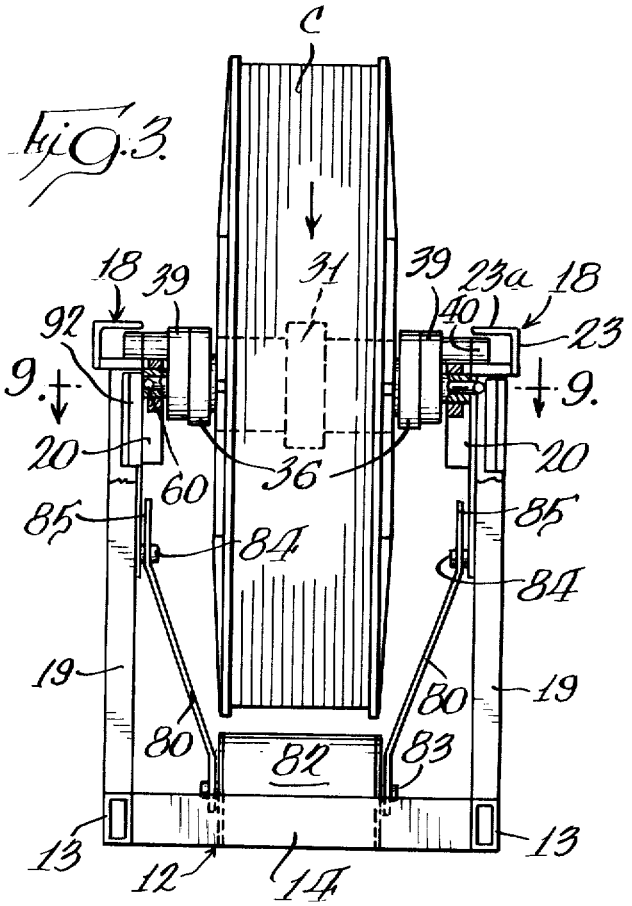
FIG. 3 is a front elevation view, partially in cross section of the dispenser of FIGS. 1 and 2.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated. The scope of the invention will be pointed out in the appended claims.

Referring now to the drawings, the strap dispensing device is designated in its entirety by reference numeral 10 and is comprised of three principle assemblies; namely, a frame 11, a dancer arm assembly 80, and an axle assembly 31 including a hub 32 carrying a coil of strap C.

Referring to FIGS. 1, 2 and 3, the frame 11 includes a rectangular base section 12 formed from box members 13 and 14 adapted to support the dispenser on the floor or other suitable base; and upwardly converging inclined members 15 and 16 and cross member 17 at each side of the frame which define essentially A-shaped supports. Horizontal guide channels 18 are provided on each side of the frame, and are secured to the upper ends of members 15 and 16 and to the upper end of vertical supports 19 at the front portion of the dispenser. A lateral frame member 21 braces the rear ends of the guide channels 18. Finally, frame 11 includes vertical guide rails 20 which extend upwardly from the central portion of each cross member 17 to one of the guide channels 18.

The horizontal guide channels 18 (FIGS. 8 and 9) are formed by horizontal support members 22 and inverted L-shaped weldments 23 to provide a three side inwardly opening channel. Members 22 are attached from beneath at the central portion to the converging members 15 and 16 and at the forward ends to vertical supports 19. The upper surfaces **22*a* of the members 22 are coplanar and horizontally disposed to provide a smooth rolling surface for rollers 37 and 40, hereinafter described. The horizontal portions 23*a* of weldments 23 function to contain the rollers 37 and 40 within the guide channels as the coil rises vertically during the stopping cycle, as discussed below. The forward ends of the guide channels 18 above supports 19 are open to allow the coil C, hub 32 and axle assembly 31 to be removed from the frame, while the rearward ends of channels 18 are closed by cross member 21 which extends therebetween. The vertical guide rails 20 (FIGS. 8 and 9) provide a smooth vertical bearing surface upon which axle bearings 50** bear while the coil is moving vertically, as is also discussed below.

The coil C of strap is mounted to the hub 32 by a mechanism 130 (FIG. 8) discussed in detail below, that assures the conjoint rotation of the coil with the hub without relative motion therebetween and permits the hub to accept coils of varying inner diameter. The hub 32 is formed of three coaxial pieces 32*a*, 32*b* and 32*c*, which may be welded or joined by other suitable means, such as by the bolts 180 shown in FIG. 13, and hub is provided with rims 132 and 132*a* which support the sides of the strap coil which is mounted therebetween. The axial portions of the hub 32 are mounted on an outer axle 33 by axially spaced pairs of bearings 34 and 35 and one-way clutches 52, between bearings 34 and 35. Clutches 52 are free to rotate in the direction of strap dispensing, as will hereinafter appear.

Axle 33 is formed of two coaxial segments 33*a* and 33*b*, and the outer end of each segment is connected to an arm 36, as by a key 43. Arms 36 are positioned at right angles with respect to axle 33 and are supported on the surface 22*a* of guide channel 18 by rollers 37. Rollers 37 are attached to arms 36 by lateral tube weldments 44 which contain coaxial mounting studs 45 upon which rollers 37 are attached by nuts 46 and washers 47.

Axle 33 is rotatably mounted on a hollow inner axle 38 by axially spaced bearings 48, and each end of axle 38 is connected to arms 39, as by keys 49. Arms 39 support axle 38 from the horizontal surface of the guide channels 18 through roller bearings 40 which are connected to the arms 39 in the same manner as rollers 37 are mounted to arms 36. Each end of axle 38 is provided with a bearing 50 which is retained thereon by a spacer and clip ring 51, and bearings 50 ride against vertical guide rail 20 during the vertical travel of the axle assembly 31.

Figure 8:
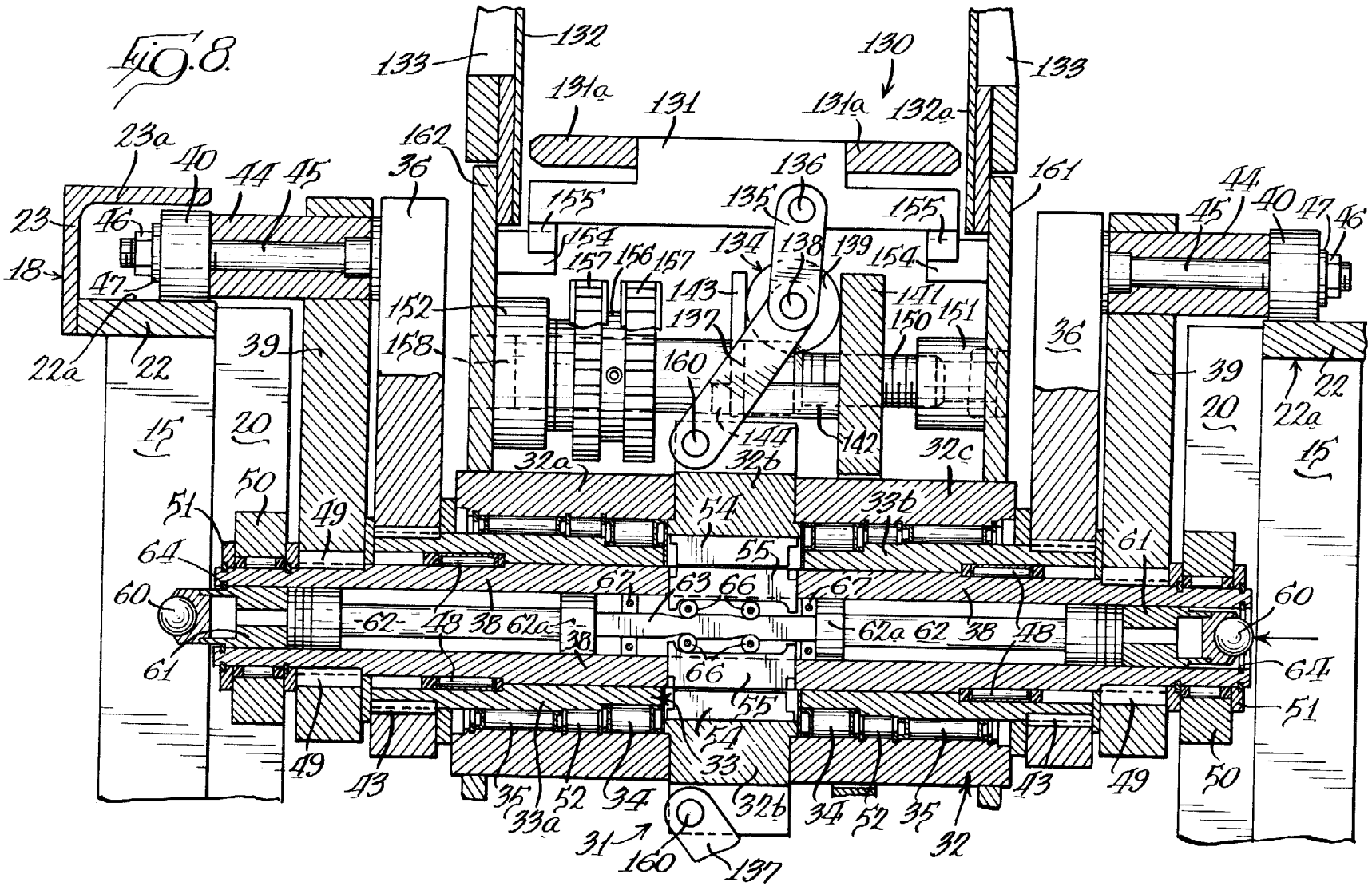
FIG. 8 is an enlarged fragmentary sectional view taken generally centrally of the dispenser, and illustrating the various mechanisms in the run position.
Figure 9:
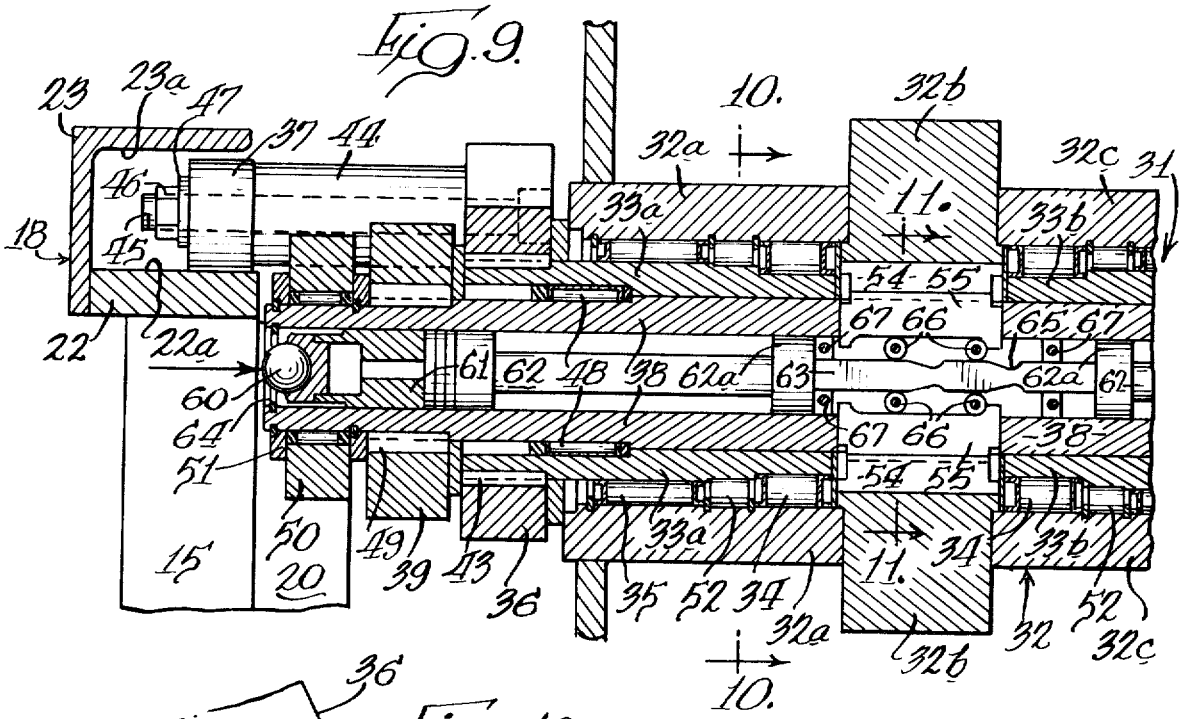
FIG. 9 is a fragmentary sectional view in the rest position with the coil mounting mechanism removed for clarity of illustration.
Figure 10:
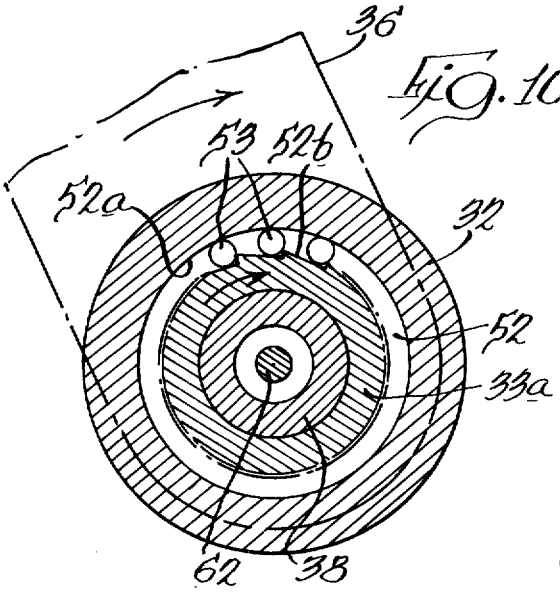
FIG. 10 is a sectional view of the one-way overrunning device, taken along plane 10—10 of FIG. 9.

The one-way clutches 52 are shown in detail in FIGS. 8, 9 and 10, but it will be appreciated that this type of device may be replaced by a variety of other mechanisms including a ratchet drive, fiber clutch or any suitable one-way overruning device without departing from the scope of the invention. Each clutch 52 includes a smooth outer race surface 52*a* formed interiorly of hub members 32*a* and 32*c* and upon which spindle bearings 53 may freely roll. Clutches 52 further include an inner surface 52*b* formed on the outer surface of axle portions 33*a* and 33*b*, with surface 52*b* being provided with a plurality of equally circumferentially spaced tangential steps.

As hub 32 rotates in a clockwise direction relative axle 33, as indicated by the directional arrow in FIG. 10, the spindle bearings 53 are free to rotate in the heel portion of the steps of surface 52*b* and the clutch overruns. However, when axle 33 rotates in a clockwise direction relative to hub 32, the spindle bearings 53 move tangentially on surface 52*b* and prevent further rotation in this direction since the clearance between surfaces 52*b* and 52*a* is reduced at the toe or end portion of the tangential surface. As will be described in more detail below, when the coil C is permitted to fall vertically in order to initiate the dispensing of strap, both the hub 32 and axle 33 rotate together so that there is no relative movement therebetween. The rotation of both elements during the falling phase of the coil accelerates the coil from the rest position to initiate rotation thereof, although during the falling phase there is no relative rotation between hub 32 and axle 33. When the axle means 31 is in the rest position (FIG. 5), the coil is supported and prevented from rotating by the combined actions of one-way clutches 52 and a keying system which releasably couples hub 32 and inner axle 38.

Figure 11:
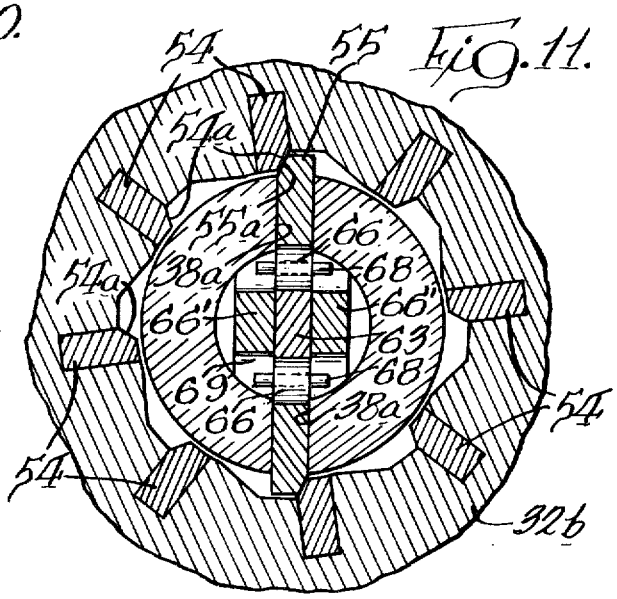
FIG. 11 is a sectional view of the radial keying system, taken along plane 11—11 of FIG. 9.
Figure 12:
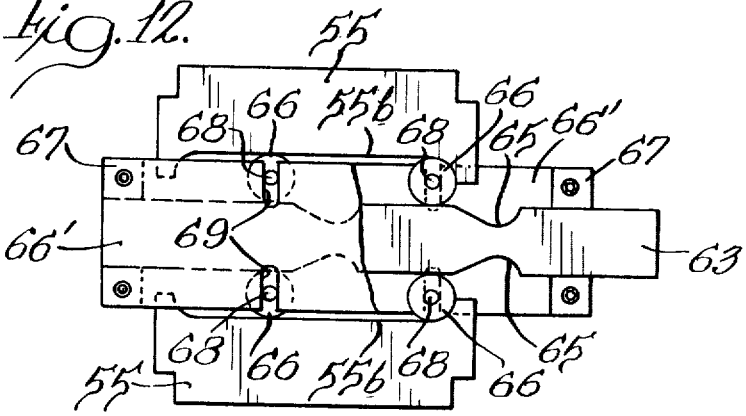
FIG. 12 is an elevation view of the key actuating cam and rollers.

The keying system can be best understood by considering FIGS. 8, 9, 11 and 12, and with specific reference to FIG. 11, the system includes a plurality of spaced abutments in the form of inserts 54 arranged radially in hub members 32*b* and cooperating with diametrically opposed keys 55 extending outwardly of axle 38. The outwardly facing engagement surfaces 54*a* and 55*a* of inserts 54 and keys 55, respectively, are set at complementary angles to each other thereby directing a component of the coil's weight towards the center of the axle assembly when the keys and inserts are engaged. This directed component of weight assures that the keys and inserts will remain engaged while the axle assembly is in the rest position of FIG. 5 and also dissipates a portion of the rotational energy as the keys engage the inserts to stop the hub 32 from rotating. Additionally, this force component is utilized to force the keys radially inwardly to initiate rotation, as discussed below. It will be appreciated that hub member 32*b* and the inserts 54 are free relative to the outer axle 33 so that rotation of the hub about the outer axle is controlled through the one-way clutches 52 only.

The movement of keys 55 is controlled by a slidable assembly contained in the center of the inner axle 38, and which is actuated through the action of the strap on a dancer arm assembly to be hereafter described. The inner axle 38 is in the form of a hollow shaft to provide for reception of the actuating mechanism, and shaft 38 is provided with diametrically opposed radial passages 38*a* in which the keys are slidably located. The key actuating mechanism includes bearings 60 which are each mounted in a slidable housing 61 at each end of the shaft 38, axially movable spools 62 slidably positioned within shaft 38 inwardly of housings 61, and cam member 63 which is positioned between the inner hub 62*a* of each spool. These slidable members are retained within the interior of shaft 38 by inwardly facing clip rings 64 at each end of shaft 38 and which act against a shoulder on housing 61. As can be best seen in FIG. 12, cam 63 includes a pair of longitudinally spaced recesses or pockets 65 in opposite faces thereof, with cam 63 further including flat parallel surfaces between and on opposite sides of recesses 65. Reacting members in the form of rollers 66 are interposed between cam 63 and keys 55, and the rollers 66 are mounted on transversed spindles 68 that are each slidably mounted in an outwardly facing slot 69 in a guide member 66 which supports cam 63 through mounting blocks 67 at either end thereof. It will be understood that slots 69 permit rollers 66 to move inwardly and outwardly relative to the pockets 65 as cam 63 is moved relative to guide member 66'. For example, as the cam 63 is moved to the left from the position of FIG. 9 to the position of FIG. 8, as occurs upon demand for strap, the component of the weight of the coil which is directed toward the center of the axle assembly (because of the angle of contact between keys 55 and inserts 54) forces rollers 66 downwardly into pockets 65 to disengage the keys. The right-hand spool 62 then contacts the right-hand blocks 67, thus permitting the rollers 66 to be moved to the left-hand position relative to surfaces 55*b*, as illustrated in FIG. 8. This movement of the rollers 66 to the left-hand portion of the keys 55 positions the rollers for moving the keys outwardly when the spools are moved to the right, as occurs when demand for strap ceases. When the spools 62 are moved to the right from the position of FIG. 8 to the position of FIG. 9, the rollers 66 are forced to ride up the ramp portion of the pockets 65 forcing the keys 55 outwardly into engagement with the inserts 54 to positively couple the hub 32 to shaft 38 to return the dispenser to the rest position, as will be explained hereafter. As the spools 62 continue to move to the right, the inner left-hand spool 62*a* contacts the left-hand guide block 67 thus causing the rollers to move to the right-hand portion of surface 54*b*.

In the preferred embodiment, the movement of the spools 62 is achieved through an over-center spring loaded mechanism 86 which is activated by the dancer arm assembly 80, as can be best seen in FIGS. 1–4. While the over-center mechanism is hereafter described in detail, it will be appreciated that other linkages, or switches or valves with a suitable connection to a power device, may be provided to move the spools. The dancer arm assembly 80 is comprised of two arms 81 adjacently disposed to either side of the hub rim and pivotally mounted to the frame cross member 17 by pins 84 to provide a fulcrum. The dancer arms 81 converge at their free ends to journal mount a roller 82, as by shaft 83. The dispenser is activated and deactivated by strap demand which is communicated to the dispenser through the dancer arms 81 and roller 82. To this end, the strap is fed from the coil downwardly under roller 82 and then upwardly over guide roller 83' (FIGS. 5–7) and to a strapping machine. In this manner, demand for the strap causes the dancer arm to pivot upwardly about the fulcrum point as demand for strap increases and downwardly as strap demand decreases.

The rear portion of one of the dancer arms 81 includes a generally perpendicularly extending actuating portion 85 which is apertured to rotatably receive a shaft 87 which includes hemispherical end portion 88 which bears against dancer arm portions 85. Shaft 87 is connected to the horizontal portion of an upwardly extending spool moving member 90 by a vertical pivot pin 89 which is seated within a slot 90*a* in member 90. As can be seen in FIG. 2, spool operating members 90 are provided at opposite sides of the dispenser frame, and each member 90 is pivotally attached to a frame cross member 17 by a vertical pin 91. Each member 90 is provided with an inwardly facing actuator portion 92 which bears against one of bearings 60 to operate the spools 62 axially within shaft 38 as the members 90 are pivoted. To provide the energy for operating the members 90 and spools 62, shaft 87 is provided with a sleeve 94 which bears against pin 89 and which is loaded by a spring 93. The spring load on pin 89 is adjustable by means of nut 95 which may be moved on a threaded portion 87*a* of shaft 87 to appropriately control the force generated against bearings 60.

Figure 5:
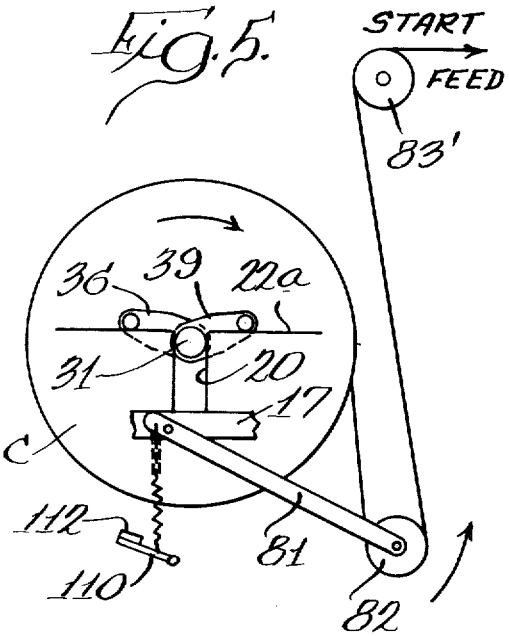
FIG. 5 is a schematic view of the dispenser in its rest position.

Assuming that the dispenser is in the rest position as shown in FIGS. 1 and 5, when demand for strap occurs, dancer arms 81 are pivoted upwardly to move the actuating portion 85 along a counterclockwise arcuate path, as viewed in FIG. 1. This movement causes the shaft 87 to pivot in a counterclockwise direction about pin 89 against the bias of spring 93, and as the shaft 87 passes over an imaginary line extending between pins 89 and 91, the over-center assembly 86 snaps into the position shown in FIG. 4 and axially shifts the spool assembly from the position of FIG. 9 to the position of FIG. 8. In a similar manner, when demand for strap ceases, dancer arms 81 pivot downwardly in a clockwise direction, as viewed in FIG. 1, to move the actuating portion 85 in an arcuate clockwise path. This movement causes shaft 87 to pivot in a clockwise direction about pin 89 until the shaft 87 passes over an imaginary line between pins 89 and 91, at which time the over-center mechanism snaps to the position shown in FIG. 2 to move the spool assembly from the position of FIG. 8 to the position of FIG. 9.

Since the spool operating members 90 are spring loaded on only one side in the illustrated embodiment, as shown in FIG. 2, the spool operating members are interconnected through a linkage system extending around the rear portion of the frame. To this end, the directly loaded member 90 is connected to a rearwardly extending link 100 by pin 89, while the dependent member 90 is connected to a rearwardly extending link 101 by a pin 89'. Links 100 and 101 are pivotally attached to a cross link 103 at their end portions by pins 104, with link 103 being pivotally attached at its center portion to frame cross member 21 by pin 105 and bushing 106 to provide a fulcrum for transferring the motion from the directly loaded member 90 to the dependent member 90.

To provide for intermediate braking action of the coil during the dispensing cycle, the dancer arms 81 are attached to a rim braking system. The braking system is comprised of a brake lever 110 which is pivotally attached to frame base member 13 by pin 111, and which is provided with a brake shoe 112 which bears against the coil rim. It should be understood that a separate brake member may be provided for each rim, or that a single brake member may be provided which engages both rims. Lever 110 is actuated by the rotation of the dancer arms 81 about their fulcrum point by a spring 113 that is attached to the middle portion of lever 110 and the cable 114 is attached to the rear portion of one of dancer arms 81. Thus, as the dancer arms rotate clockwise due to a decrease in strap demand, the brake lever 110 and shoe 112 are raised upwardly against the rim to provide intermediate braking. However, if strap demand has ceased, the dancer arms 81 will continue to rotate clockwise and actuate the over-center mechanism 86 to cause the keys to engage the inserts and stop coil rotation completely.

In the operation of the dispensing unit, starting from the stopped position (FIG. 5), the hub 32 on which the coil is mounted and axles 33 and 38 are supported in the rest position at an elevated position relative to the vertical guide rail 20 by axle arms 36 and 39 acting upon surface 22*a* of guide channels 18. In this position the arms 36 and 39 are in an approximately horizontal position, and the hub 32 is constrained from rotation about axle arms 39 by the engagement of the keys 55 against the inserts 54 and constrained from rotation about axle arms 36 through the one-way clutches 52. In the rest or stopped position, the guide rollers 50 are positioned adjacent the upper portion of the vertical guide rails 20 (FIG. 9), and the spool operating members 90 are positioned so that the inserts 54 and keys 55 are engaged. Since the coil is in this upper position, the rims of the hub are out of contact with the brake shoe 112.

Upon demand for strap, initiated by a strapping machine, the dancer arms 81 are forced to pivot upwardly activating the over-center mechanism 86. As the dancer arms 81 reach the designated start position, the over-center mechanism causes the spool 62 to move to the left, i.e., from the position of FIG. 9 to the position of FIG. 8. The movement of spools 62 causes the cam 63 to move to the left also, thereby disengaging the inserts 54 and the keys 55 as the rollers 66 enter the pockets 65 in cam 63. As is described above, the keys 55 due to their angle of contact with the inserts 54 direct a component of the coil's weight towards the center of the axles 33 and 38. This force keeps the keys 55, rollers 66 and cam 63 in constant contact with each other and working as a unit. As the cam 63 moves under the action of the over-center mechanism, the rollers 66 and guide member 66' roll on the cam and the keys. As the rollers 66 approach the pockets 65 in cam 63, the force component forces the keys 55 and rollers 66 inwardly, disengaging the keys from the inserts 54 and the hub assembly 32. Due to this disengagement, the hub 32 is free to fall vertically and is guided by rollers 50 acting against the vertical guide rail 20.

Figure 6:
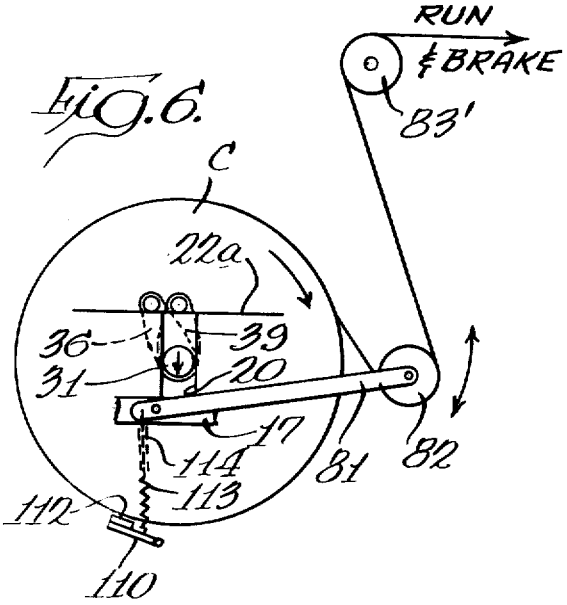
FIG. 6 is a schematic view of the dispenser in its strap dispensing position.
Figure 7:
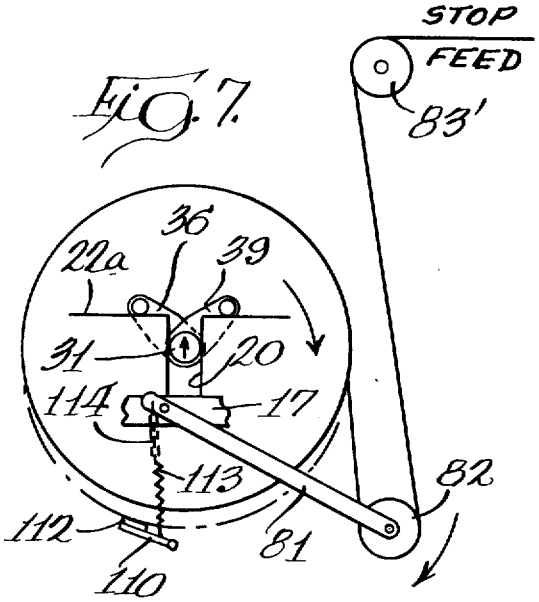
FIG. 7 is a schematic view of the dispenser in an intermediate position during movement from the strap dispensing position to the rest position.

As the hub 32 falls, the one-way clutches 52 holding the coil and hub to arm 36 remain engaged since there is no relative movement between the hub 32 and axle 33. The hub 32 is forced to rotate about the point of contact between rollers 37 on arm 36 and upper surfaces 22*a*. The coil C continues to fall until arms 39 have moved into a vertical alignment with axles 33 and 38, at which time the hub 32 begins to overrun the arms through the one-way clutches 52 (FIG. 6).

The hub is then continually accelerated by the dancer arms 81 as they maintain constant tension in the strap between the demand source and the coil. If during the feed cycle, the hub speed exceeds the demand speed, the dancer arms 81 will pivot down and move the brake shoe 112 into contact with the hub rim to provide intermediate braking. The brake shoe 112 will slow the hub down until the speed of the hub is the same or slower than the demand speed. As demand source speed increases, the dancer arms 81 will pivot upwardly and disengage the brake shoe 112 from the coil rim (FIG. 6).

When the demand for strap is terminated, the hub 32 will tend to continue to rotate and feed off strap due to its rotational inertia. The dancer arms 81 will then pivot downwardly (FIG. 7), moving the brake shoe 112 into contact with the hub rim and, because of the spring connection in the brake mechanism, the dancer arms will continue downwardly to the stopped position. At the stop position, the over-center mechanism 86 is again actuated to force the spools 62, cam 63 and guide member 66' to move the rollers 66 out of the pockets 65 and into the engaged position, thus forcing the keys 55 radially outward to engage the inserts 54 (FIG. 9). As the keys 55 engage the inserts 54, rigid contact is again initiated between axle 38 and hub 32. Support arms 39 now act as pivot arms between the hub 32 and the upper surfaces 22*a* and the hub 32, in attempting to rotate the axle 38, creates a moment about the point of contact between rollers 40 on arms 39 and the upper surfaces 22*a*, thus causing the hub to pivot upwardly about these arms. As the hub moves upwardly, the support arms 36 and 39 move away from each other in proportion to the rotational energy of the coil as shown in FIG. 5. The coil C continues to rise until all the rotational energy is dissipated in the form of work generated in lifting itself relative to the frame. At this point, the coil has reached equilibrium and is locked in the up position (FIG. 5). The weight of the coil C is supported by arms 36 through the one-way clutches and by arms 39 through the engaged keys 55 and inserts 54. The coil will remain in the locked up rest position until demand from the strapping machine again causes the dancer arms to pivot upwardly into the start position.

The dispenser of the present invention also includes a novel mechanism 130 for clamping the inner diameter of a coil of strap, with the clamping means being adjustable to accept coils having different inner diameters and for accepting coils of different widths. The coil clamping means is illustrated in the clamped position in FIGS. 8 and 13–15 and includes a plurality of circumferentially spaced clamping shoes 131 (four such shoes being utilized in the illustrated embodiment), with the shoes 131 each being movable between a pair of parallel coil retaining rims or flanges 132 and 132*a*. Rim 132 is removable for loading of new strapping coils. Each shoe 131 has an arcuate outer surface 131*a* (FIG. 13) to complement the interior surface of the strapping coil. Follower tabs 155 may be provided at opposite ends of shoes 131 to bear against guides 154 during movement of the shoes.

The clamping shoes 131 are movable inwardly and outwardly simultaneously to decrease and increase the effective diameter of the hub, and identical linkages 134 are provided for moving each clamping shoe 131. Linkages 134 each include a pair of parallel first links 135 that are connected at one end by pin 136 to a clamping shoe 131, with the opposite end of links 135 being pivotally connected by pin 138 to a pair of parallel second links 137, which are pivotally connected at their opposite end by pin 160 to hub portion 32*b*.

An identical linkage operating mechanism is provided for each linkage means 134, and each mechanism includes an adjusting shaft 150 which is rotatably supported at its opposite ends by bushings 151 and 152. Each shaft 150 extends through its respective bushing 151 to mount a disc stop 153 at the end thereof. Each end stop 153 is axially movable with the end of its shaft 150 in a counterbore 153*a* defined in bushing 151 and fixed hub plate 161. A cradle 140 is mounted for axial movement along each adjusting shaft 150. The cradle includes an annular plate 141 which has internally threaded portions that receive the externally threaded portion of shafts 150 so that the cradle is axially movable relative to shafts 150 when shafts 150 are rotated. A pair of spaced rollers 139 are mounted upon pin 138 and are held against plate 141 by a U-shaped cover plate 143 that is secured in spaced parallel relationship to plate 141 by screws 144 and spacers 142. From the foregoing, it will be appreciated when shafts 150 are rotated, the cradle assembly 140, including portions 141–143, will move axially relative to the shafts and pivot the linkage means 134 about pin 160 to move the clamping shoe inwardly or outwardly, depending upon the direction of rotation of shafts 150.

Figure 13:
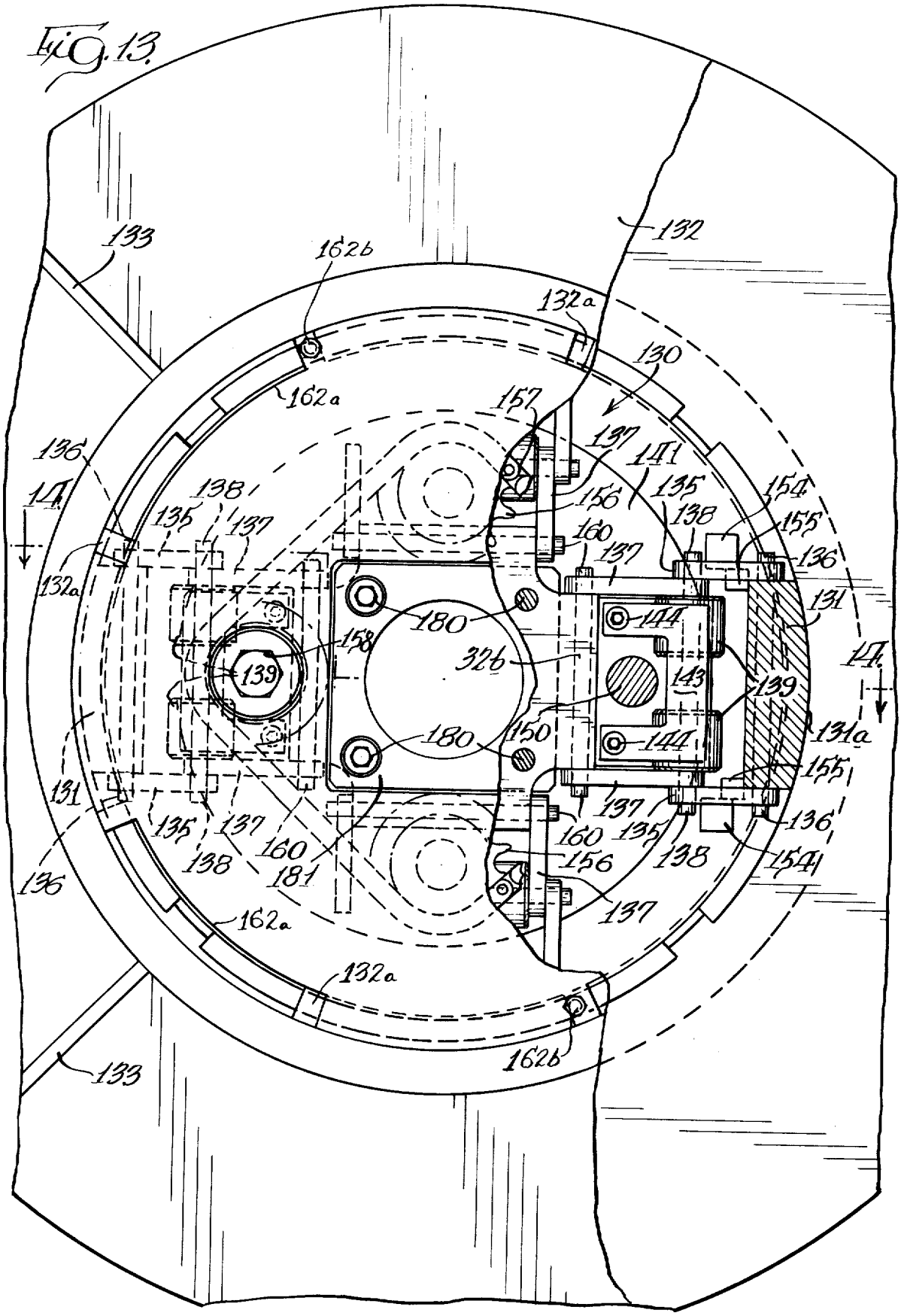
FIG. 13 is an elevation view, partially in cross section of the coil mounting mechanism.
Figure 14:
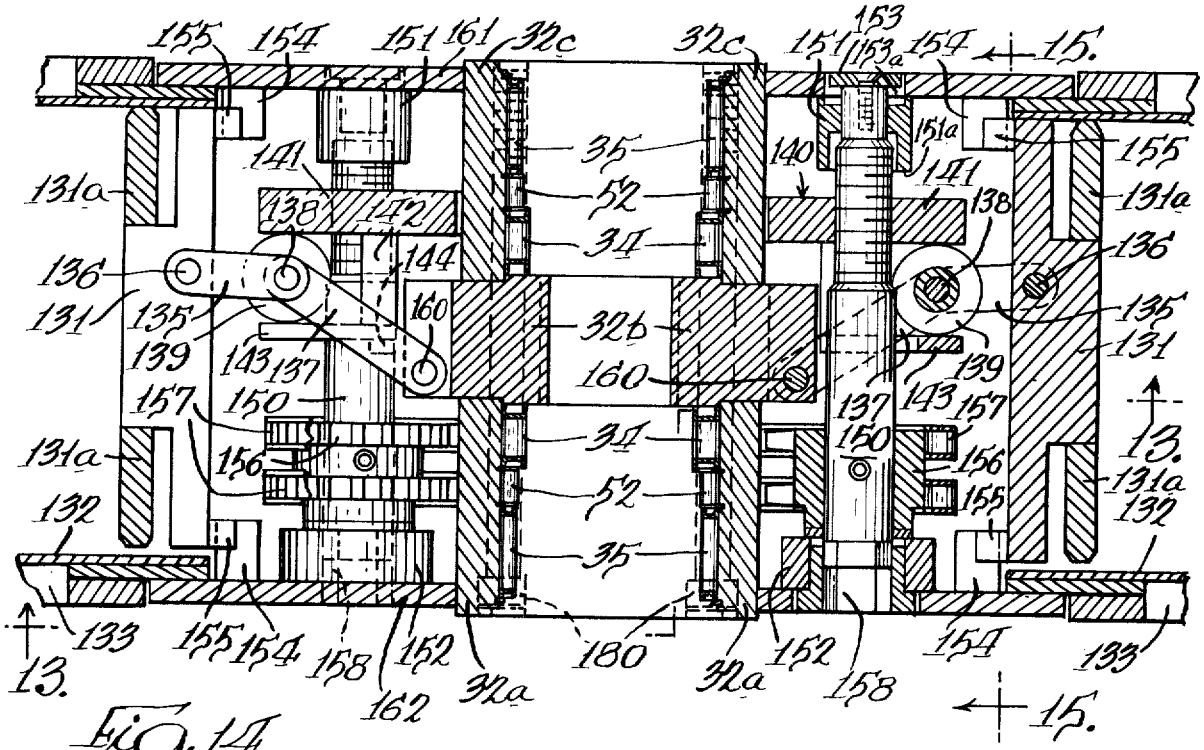
FIG. 14 is a sectional view of the coil mounting mechanism, with the axle mechanism removed for clarity of illustration, taken along plane 14—14 of FIG. 13.
Figure 15:
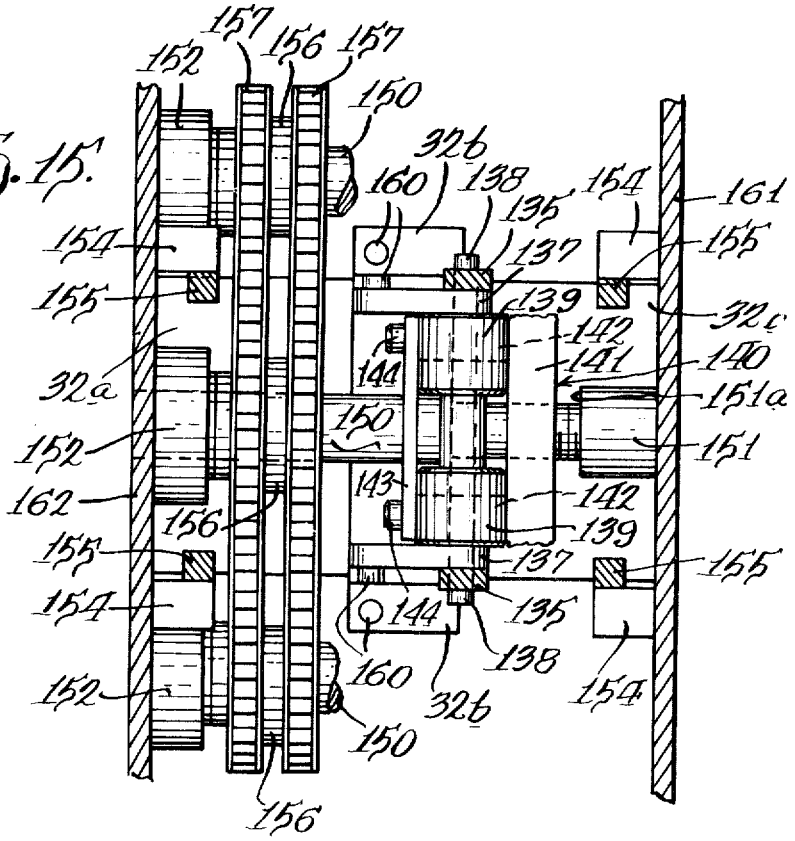
FIG. 15 is a sectional view of the coil mounting mechanism taken along plane 15—15 of FIG. 14.

To provide for conjoint movement of shoes 131, each shaft 150 is provided with a sprocket 156 which is keyed thereto. The sprockets 156 are interconnected by two endless chains 157 which are operated by rotating one of the shafts 150 as by a key in socket 158 formed in the end of one of the shafts (FIG. 13).

In order to mount a new coil of strap, the empty hub 32 is removed from the frame 11 by lifting the axle assembly 31 upwardly so that rollers 50 are clear of rails 20. The entire assembly may then be rolled to the forward end of channels 18 and removed. The means for accepting a new coil (which may be of a different width) is provided by hub side plate 162 which is axially movable relative to hub 32. By rotating shafts 150, plate 141 is moved into abutting relationship with the inner end 151*a* of each bushing 151. At this point, shoes 131 are fully retracted. Continued rotation of shafts 150 causes the shafts to "unscrew" themselves from plate 141 thus causing plate 162 to be moved outwardly until stops 153 seat in counterbores 153*a*. A clearance is produced between rim 132 and plate 162 to allow the rim to be removed and a new coil placed in position. To this end rim 132 is provided with four, spaced apart inwardly directed radially projections 132*a*, and plate 162 is provided with complementary cut outs 162*a*. To remove rim 132, it is rotated to place each projection in register with a cut out and the rim is lifted clear of the plate 162. After a new coil is positioned on the hub, the rim projections are inserted through the cut outs and rotated to place the leading end of each projection in abutment with a stop stud 162*b*, FIG. 13. Thus rim 132, which is reinforced by radial struts 133, is secured against axial movement outwardly by plate 162.

After a new coil has been positioned and rim 132 is replaced, shafts 150 are rotated in the opposite direction to cause them to "screw" into plate 141. This rotation causes plate 162 to be moved inwardly and draws rim 132 into engagement with the side of the new coil. Continued rotation of shafts 150 draws plate 141 away from bushing 151 to cause shoes 131 to clamp against the inner diameter of the coil, as described above. After the shoes 131 clamp the inner diameter of the coil, continued rotation of the shafts 150 produces a squeezing action between plates 141 and 162 which results in a side force through rim 132 to maintain the rim against the side of the new coil.

Figure 16:
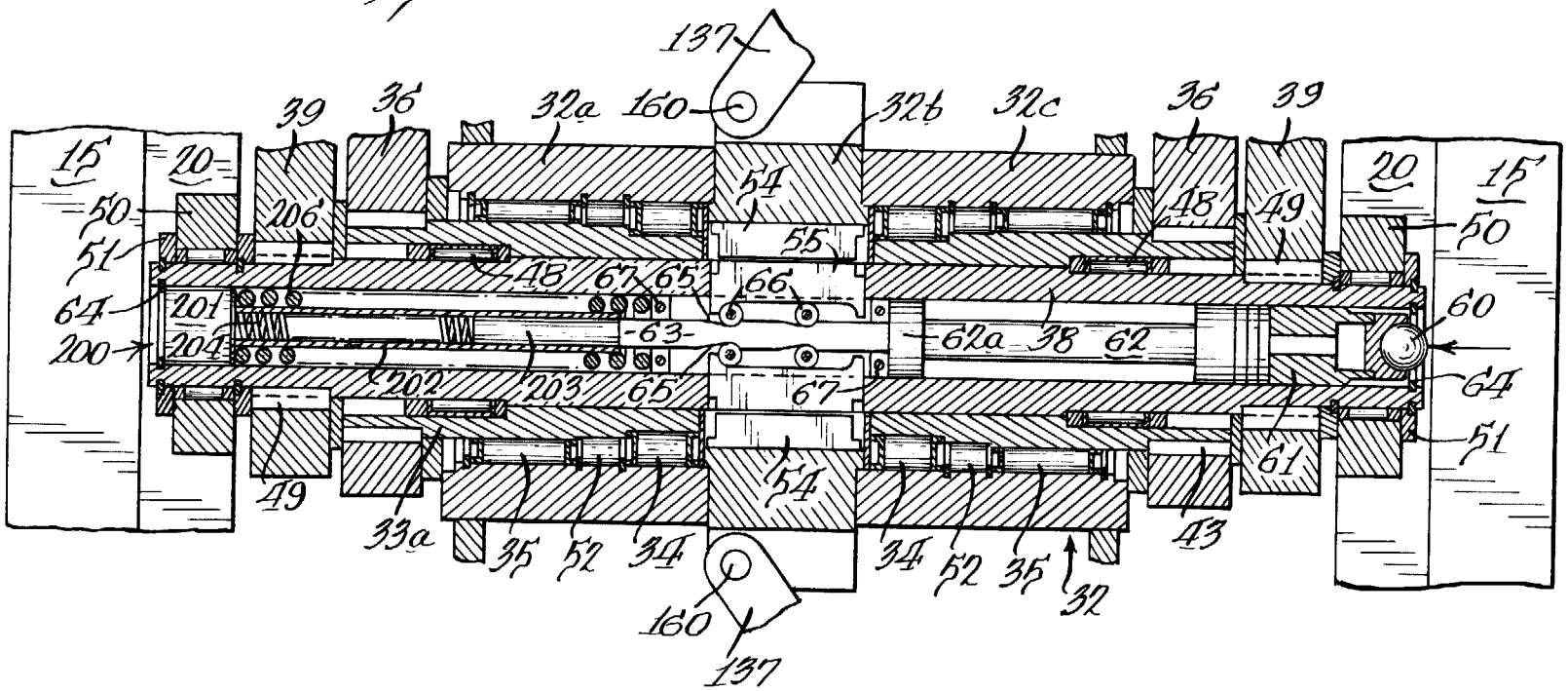
FIG. 16 is a fragmentary sectional view taken generally centrally of an alternate embodiment of the dispenser, and illustrating the various mechanisms in the run position.

Referring now to FIGS. 16 through 20, there is illustrated an alternate embodiment for actuating the hub assembly. The alternate mechanisms are conveniently used with the dispensing device previously described with only minor substitutions and deletions of mechanisms previously described. With particular reference to FIG. 16, elements corresponding to those elements previously described are designated by the same numerical designation. In this embodiment, the keys 55 are actuated by a single over-center mechanism, described in detail below, which forces the spool 62 to the left, FIG. 16, to initiate strap dispensing. The dispensing operation is terminated and the hub raised to an elevated position, as described above, by spring mechanisms within the inner axle 38, rather than by an over-center mechanism on the opposite side of the axle.

Referring to FIG. 16, it will be observed that the right-hand mechanism within inner axle 38 is identical to that previously described. To initiate hub rotation cam 63 and the left-hand guide block 67 are moved to the left, and compress a spring-loaded return system 200, which is contained within the left-hand portion of the inner axle 38. The spring return mechanism 200 includes a circular mounting block 201 positioned at the left-hand end, FIG. 16, of the inner axle 38 and is secured thereto by means of spring clip 64. Block 201 locates an elongated tube 202 which extends therefrom to a location spaced from the center of the dispensing hub. Tube 202 is positioned axially within the inner axle 38 and has interior dimensions corresponding to the outer dimensions of cam 63 so that the left-hand portion of cam 63 is slidably received within the tube. A piston 203 is slidably mounted within tube 202 and biased outwardly against the left-hand end of cam 63 by means of a compression spring 204 disposed between piston 203 and block 201. In this manner, as cam 63 moves to the left, it forces piston 203 to the left and compresses spring 204 to provide a returning force for the cam when dispensing is to be terminated.

A second compression spring 206 is mounted concentrically about tube 202 and is disposed between block 201 and the left-hand guide block 67 so that as this guide block is moved to the left, spring 206 is compressed to provide a returning force on the left-hand guide block 67 to move the guide member 66' when dispensing is to be terminated. The compressive force generated in springs 204 and 206 is sufficient to operate the keys and the over-center mechanism. In this manner springs 204 and 206 will cause spool 62 to move to the right if the over-center mechanism does not overcome the compressive forces of the springs.

Figure 17:
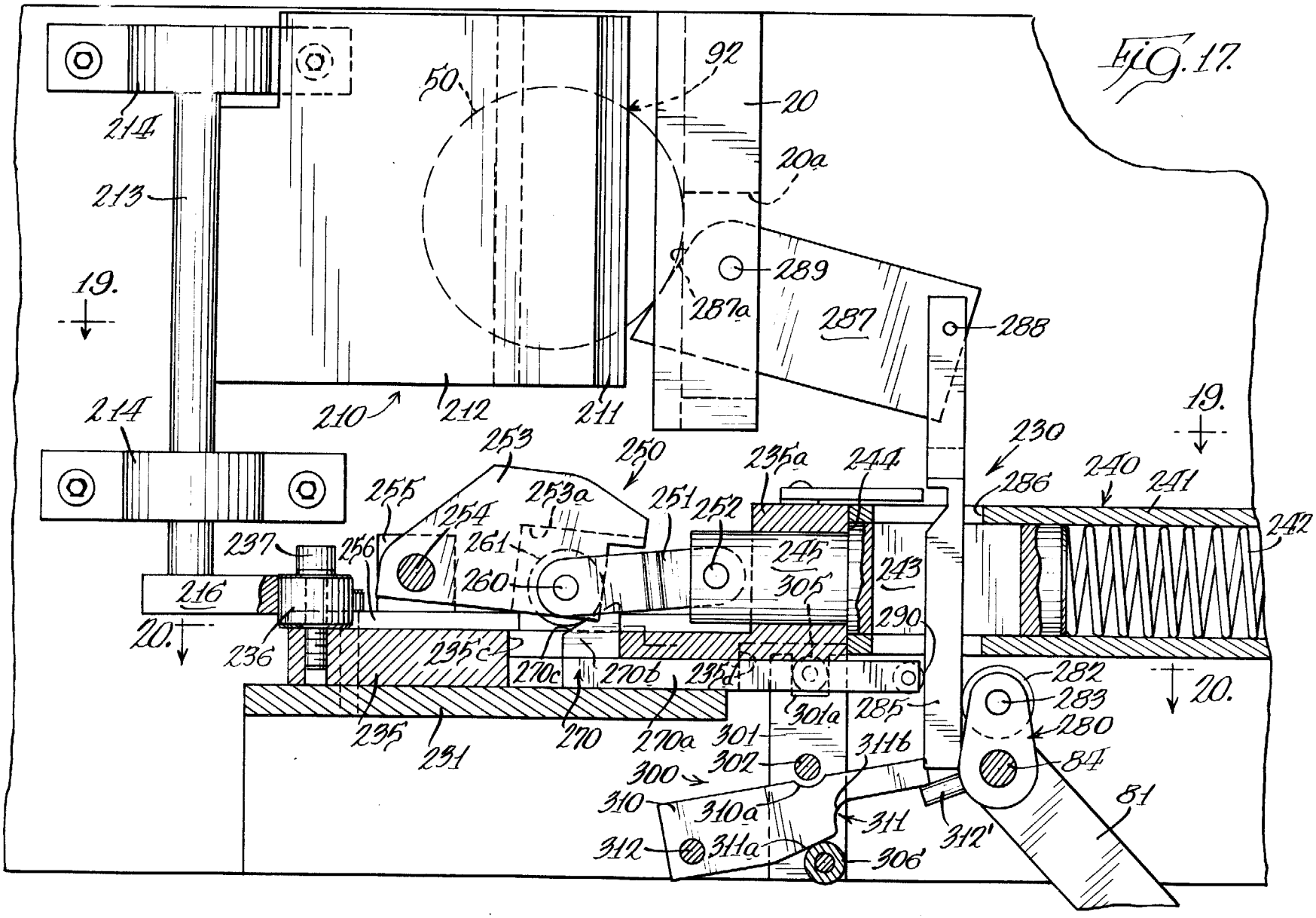
FIG. 17 is an enlarged fragmentary side elevation view with certain portions broken away for clarity of illustration, illustrating the over-center mechanism used to operate the mechanism in FIG. 16 in the rest position.
Figure 19:
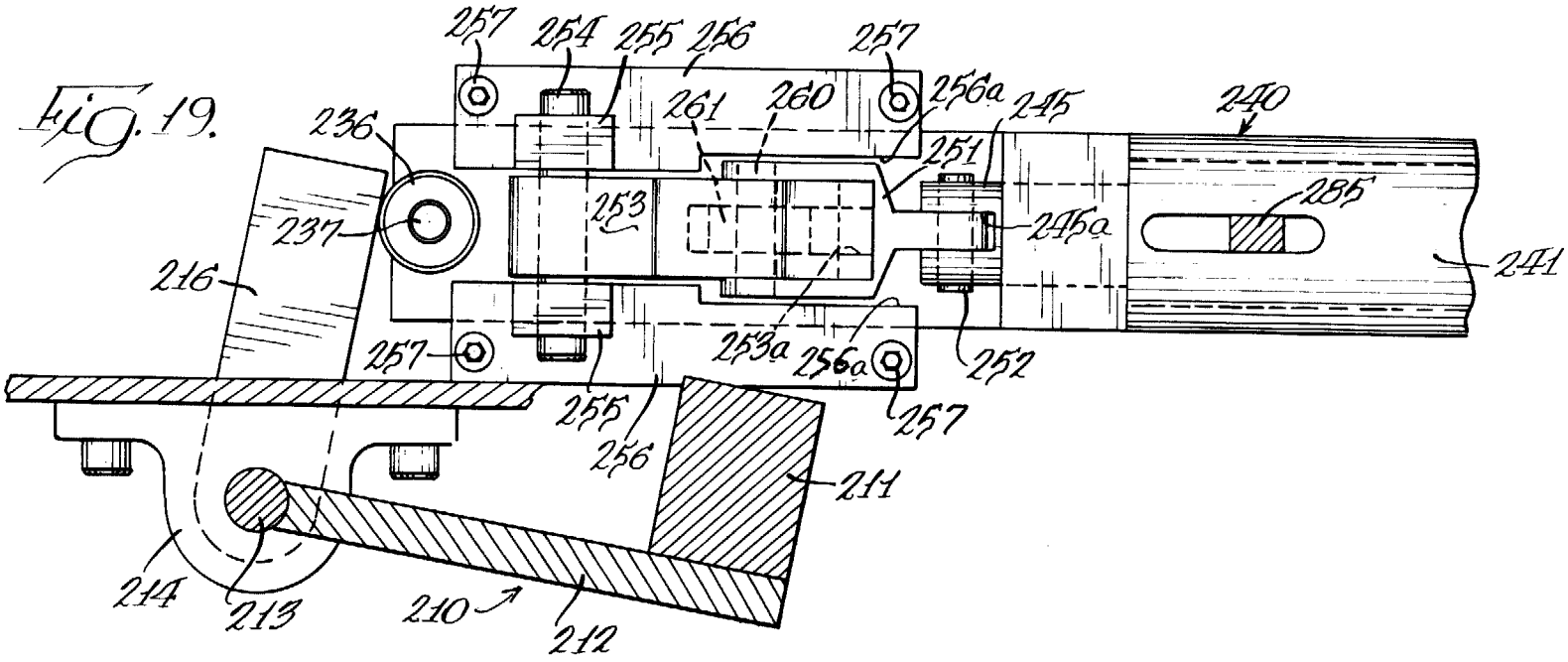
FIG. 19 is a sectional view taken along line 19—19 on FIG. 17.

FIGS. 17 and 19 illustrate the over-center mechanism for operating the right-hand spool 62. Mechanism 210 is freely rotatable and includes an inwardly facing actuator portion 211, similar to actuator portion 92, FIG. 4, which is mounted at the end of a pivot plate 212. Plate 212 is attached at the opposite end to a vertical shaft 213 which is rotatably mounted to the machine frame at spaced vertical locations by means of bearings 214. Shaft 213 extends below the elevation of the lower bearing 214 and is provided with an actuator arm 216. Actuator arm 216 is pivoted counterclockwise, as viewed in FIG. 19, to cause actuator portion 211 to bear against bearing 60, FIG. 16, and thus cause the keys 55 to disengage inserts 54 and allow the hub to fall vertically and initiate strap dispensing. Conversely, if the force of springs 204 and 206 is greater than the force on arm 216, the over-center mechanism will pivot clockwise and dispensing will be terminated.

Actuator arm 216 is forced to rotate counterclockwise by means of a spring-loaded mechanism 230 which is controlled by the right dancer arm 81 and primed by the axle assembly as it falls from its elevated position to the dispensing position. The spring loaded mechanism 230 includes in essence three sub-assemblies (1) a trigger assembly for operating a spring-loaded cylinder 240 to cause actuator arm 216 to be rotated counterclockwise and thus operate the over-center mechanism 210, (2) a latching mechanism for holding and releasing actuator portion 211 from a biased position against roller 60 and (3) a resetting mechanism for priming the cylinder 240. Nonetheless, the mechanisms for performing these functions operate cooperatively and interdependently to form a true combination.

The spring-loaded mechanism 230 is mounted on the frame below the elevation of the actuator member 211 on a horizontal plate 231 extending inwardly from cross member 17. Plate 231 is provided with two elongated spacers, 232*a* and 232*b*, FIG. 20, which extend longitudinally along each side of the plate and define two inwardly facing guide surfaces 233*a* and 233*b*. A generally rectangularly shaped slide 235 is slidably positioned between surfaces 233*a* and 233*b*. Slide 235 mounts a horizontally disposed roller 236 on its upper surface at the left-hand end, FIG. 19, by means of stud 237. Roller 236 is utilized to engage and rotate actuator arm 216 counterclockwise to initiate strap dispensing.

Slide 235 is operated by means of spring-loaded cylinder 240 mounted at the right hand end of plate 231. Cylinder 240, FIG. 17, includes an outer sleeve 241, a compression spring 242 mounted concentrically within sleeve 241, and disposed between one end of the sleeve (not shown) and a piston 243 at the other end. Spring 242 is designed to generate a force sufficient to overcome the force of springs 204 and 206 and operate the over-center mechanism. Piston 243 is provided with an annular shoulder portion 244 at its exposed surface and a reduced diameter portion 245 which extends outwardly therefrom. Slide 235 is provided with a collar portion 235*a* at its right end which is slidably mounted on the reduced diameter portion 245 of the piston 243 and engagable with shoulder portion 244. As compression spring 242 expands, slide 235 is forced to the left as viewed in FIG. 17 to cause roller 236 to rotate actuator arm 216 and thus operate the over-center mechanism 210. Slide 235 is constrained to slide between surfaces 233*a* and 233*b* by two elongated guides 256 which overlie the edges of the slide and top surfaces of spacers 232*a* and 232*b*. Guides 256 are secured to plate 231 by bolts 257 which extend through spacers 232*a* and 232*b*.

Cylinder 240, shown in its primed state in FIG. 17, is maintained in this position by means of a toggle linkage 250. Linkage 250 includes a Y-shaped link 251, FIG. 19, pivotally mounted at its leg in a vertical U-shaped cut-out 245*a* within the reduced diameter portion 245 of the piston by means of pin 252, and second link 253 which is pivotally mounted at one end by means of pin 254 to mounting blocks 255, which extend upwardly from guide members 256. Link 253 is contoured at its upper surface, to be described in greater detail below, and is provided with a vertical cut-out 253*a* at the end opposite pin 254. The yoke portion of link 251 encompasses the abutting end of link 253 and is pivotally attached thereto by means of a pin 260. Pin 260 also mounts a roller 261 within cut-out 253*a* of link 253. The guides 256 are provided with inwardly facing clearance cut-out 256*a* which permit the toggle linkage to be flexed downwardly and when the toggle linkage is flexed downwardly roller 261 bears against the inclined surface 270*c* of a second slide (described in detail below) which acts as a support for the linkage in the primed position. Thus it will be appreciated that when the toggle linkage 250 is in the position shown in FIG. 17, i.e. with the center of pin 260 below the center line between pins 252 and 254, the piston 243 is maintained in its retracted or compressed condition preparatory for operation.

Figure 20:
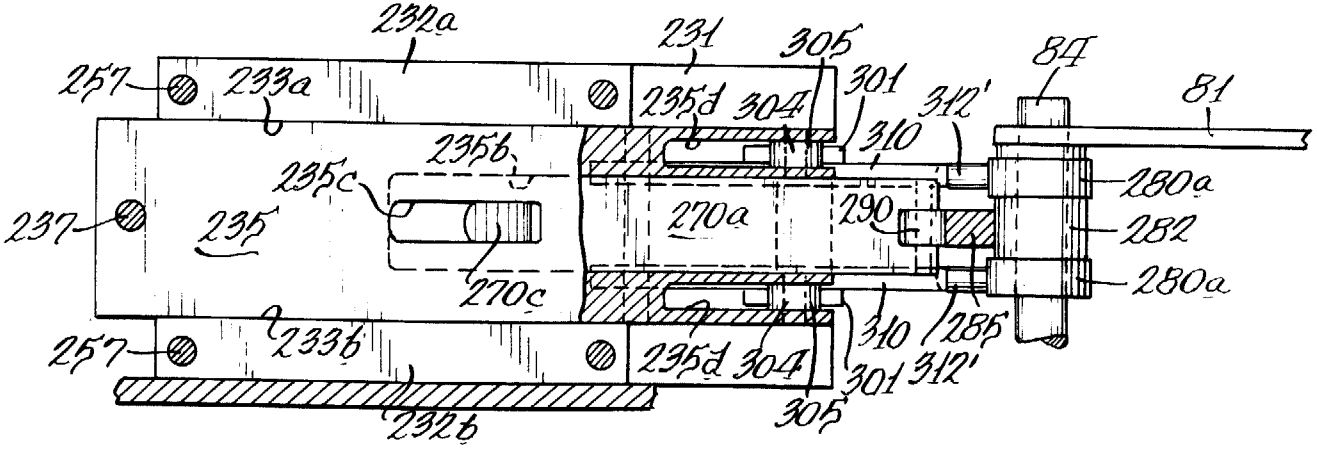
FIG. 20 is a sectional view taken along line 20—20 on FIG. 17.

To initiate strap dispensing, the toggle linkage is operated by means of a second slide 270 FIGS. 17 and 20 which includes an elongated section 270*a* which is slidably positioned in a generally rectangular cut-out 235*b* in the bottom surface of slide 235 and an upwardly extending actuator portion 270*b* which protrudes through a cut-out 235*c* in slide 235. Actuator portion 270*b* is provided with an angled bearing surface 270*c* for supporting roller 261 when piston 240 is in the primed position, as well as, for forcing toggle linkage 250 upwardly to trigger cylinder 240.

Slide 270 is actuated to commence dispensing by one of the dancer arms 81 which is pivotally mounted on pin 84 and provided with an actuator linkage 280 which rotates conjointly with the dancer arm 81 about pin 84. Linkage 280 includes two spaced apart links 280*a* which mount a cam roller 282 therebetween by pin 283 at their ends opposite pin 84. As dancer arm 81 is pivoted counterclockwise (as viewed in FIG. 17), due to a demand for strap, cam roller 282 is also forced to rotate counterclockwise into engagement with a vertically disposed link 285. Link 285 extends downwardly through a cut-out 286 in cylinder 240 and piston 243 and is pivotally attached at its upper end to link 287 by means of pin 288. Link 287 is pivotally attached to guide rail 20, which is provided with a cut-out 20*a* to receive link 287, by pin 289. The surface 287*a* of link 287 abutting bearing 50 functions as a bearing surface to bear against bearing 50 so that link 287 is pivoted counterclockwise about pin 289 as the hub assembly falls from the rest position. Link 285 is freely hanging from pin 288 and as it is forced to the left under the influence of cam roller 282, it moves within cut-out 286 and laterally bears against a roller 290 pivotally mounted at the end of slide 270 thereby causing slide 270 to move to the left.

As slide 270 moves to the left, bearing surface 270*c* causes roller 261 to ride up its inclined surface and be forced upwardly. After the center line of pin 260 has crossed the center line between pins 252 and 254, the compression spring 242 causes the toggle linkage to be forced upwardly into the position shown in FIG. 18. As the toggle linkage is forced upwardly, shoulder 244 of piston 243 bears against collar 235*a* of slide 235 thereby causing the slide to move to the left so that roller 236 rotates actuator arm 216 counterclockwise and thus forcing the over-center mechanism 210 inwardly against roller 60, as illustrated in FIG. 18.

As the hub assembly falls from its elevated position to the dispensing position and overrides the one-way clutch, bearing 50 strikes an angled surface 253*b* which is positioned in a generally horizontal orientation. The weight of the hub bearing on surface 253*b* forces linkage 250 downwardly thus causing piston 243 to slide relative to collar 235*a* be forced to the right and compress spring 242. Thus, by allowing the reduced diameter portion 245 to slide relative to collar 235*a*, the spring-loaded piston 243 is returned to a compressed state by the falling hub. Moreover, slide 270 is returned to the right under the influence of roller 261 bearing against surface 270*c* as linkage 250 is pressed downwardly under the weight of the hub.

Figure 18:
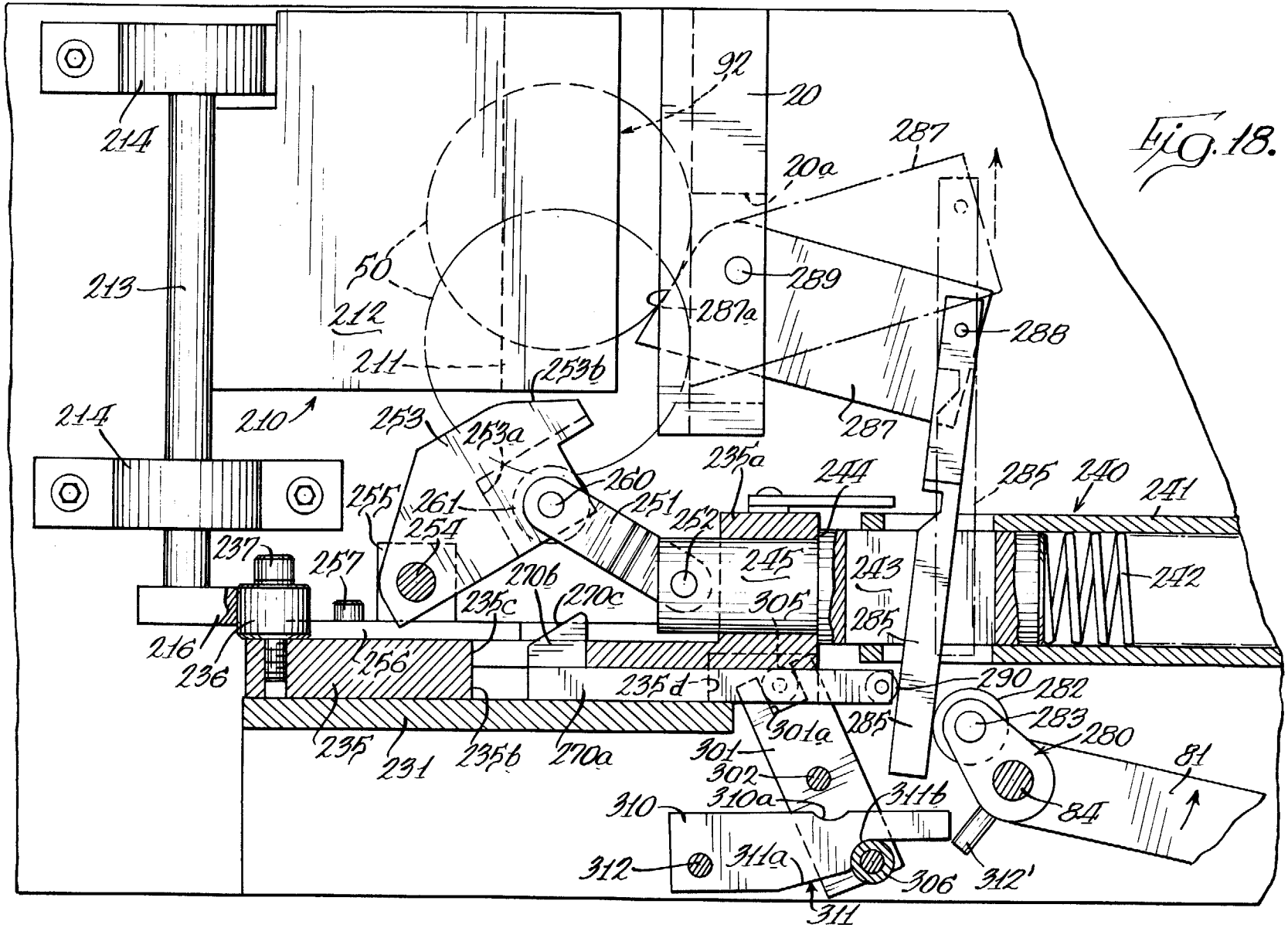
FIG. 18 is a side elevation view similar to FIG. 17 illustrating the over-center mechanism in an intermediate start position.

As the hub falls, bearing 50 bears against surface 287*a* of link 287 to cause the link to be pivoted counterclockwise and thus raised to the position shown in phantom line on FIG. 18. In this manner, the dancer arm 81 may continue to pivot counterclockwise in response to demand for strap.

When slide 235 has been actuated to commence dispensing and cylinder 240 has been primed, it will be appreciated that slide 235 must be maintained in the actuating position since it is freely slidable and to this end a latch mechanism 300 is provided. The latch mechanism 300, FIGS. 17 and 18, includes a pair of pivot links 301, FIG. 20, which are pivotally attached to the frame by means of pin 302. The upper ends of links 301 extend into elongated cut-outs 235*d*, in the right-hand end of slide 235 and are provided with upwardly opening U-shaped cut-outs 301*a* which encompass rollers 305 mounted in cut-outs 235*d* by means of pins 304. Thus as slide 235 is moved to the left, links 301 will be forced to rotate counterclockwise into the position illustrated in FIG. 18.

The lower ends of links 301 are provided with outwardly facing cam rollers 306 which are utilized to operate locking latches 310, which maintain the slide 235 in the left position during strap dispensing. Locking latches 310 have contoured locking surfaces 311 at their lower edge and are pivotally mounted to the frame by means of pin 312 outboard each pivot link 301. Locking surfaces 311 are provided with inclined entrance ramps 311*a* on which rollers 306 may ride into locking pockets 311*b* which conform to the shape of rollers 306. Latches 310 are maintained in locking engagement with rollers 306 under their own weight or may be provided with means for biasing them counterclockwise as viewed in FIG. 18. In this manner slide 235 is maintained in the dispensing position. To terminate dispensing, the latches 310 need only be released from the locked position and springs 204 and 206 within the inner axle will engage the keys 55 with the inserts 54, operate the over-center mechanism 210 and return slide 235 to the position of FIG. 17. To this end linkage 280 is provided with two pivot levers 312′ which extend rearwardly from the pivot point of the dancer arm and are positioned beneath the leading end of latches 310 so that as the dancer arm 81 pivots downwardly in response to termination in demand for strap the pivot levers 312′ lift the latches from the locked position shown in FIG. 18 thereby allowing slide 235 to move to the right under the influence of the pressure created by springs 204 and 206. Latches 310 are provided with a semicircular cut-out 310*a* which allows the latch to be rotated upwardly and clear pin 302 during the unlocking operation. As the hub rises to an equilibrium elevation, link 287 is rotated to lower link 285 into the position shown in FIG. 17.

From the above description it will be apparent that the operation of the mechanisms shown in FIGS. 16–20 is as follows: When the dispensing hub is in the rest position at an elevated location, springs 204 and 206 bias spool 62 to the right, thus maintaining the over-center mechanism in the position shown in FIG. 19. When a demand for strap is received by the dancer arm 81, cam roller 282 forces link 285 to the left to cause slide 270 to trigger toggle linkage 250. After toggle linkage 250 has been triggered, the spring-loaded cylinder 240 forces slide 235 to the left to cause actuator arm 216 to be rotated so that actuator 211 forces spool 62 to the left in FIG. 16. As the hub is released by the keys 55, it falls vertically causing link 287 to rotate counterclockwise and lift link 285 to a clearance position, as illustrated in phantom line in FIG. 18. As slide 235 moves to the left, pivot links 301 rotate causing rollers 306 to ride on the entrance surfaces 311*a* into pockets 311*b* thus locking slide 235 in the actuated position. As the hub strikes surface 253*b*, the toggle link is forced downwardly resetting the cylinder 240 and returning slide 270 to the ready position.

Strap will be continued to be dispensed in response to demand and when demand is terminated, dancer arm 81 will pivot downwardly lifting latches 310 upwardly thereby allowing rollers 306 to roll on surfaces 311*a*. When latch 310 has been lifted, springs 204 and 206 force bearing 60 outwardly to cause the over-center mechanism to rotate. As the over-center mechanism rotates, actuator arm 216 bears against roller 236 to force slide 235 rearwardly into engagement with shoulder portion 244. As the over-center mechanism is being rotated clockwise, the keys 55 are forced outwardly into engagement with inserts 54 to terminate strap dispensing and the hub rises vertically as described above, to an elevated position, thus allowing link 287 to pivot clockwise and lower link 285 into position adjacent cam roller 282 thus presenting the mechanism in condition for repeated operation.

While the disclosed embodiment and modification teach the use of transforming the rotational energy of the coil into a vertical force for storing potential energy, it will be appreciated that other methods of energy transformation and storage, (such as, storing the energy in a spring) may also be utilized without departing from the scope of the invention.

What is claimed is:

1. A method of dispensing strap comprising: providing a coil of strap on a hub; sensing demand for strap; moving said hub from an elevated rest position to a lowered strap feeding position in response to demand for strap to accelerate said hub; and decelerating said hub and utilizing the rotational energy of said hub to raise the same from the strap feeding position to the rest position in response to termination of strap demand.

2. The method of claim 1 in which strap demand is sensed by training the strap around a dancer arm assembly.

3. The method of claim 1 in which the step of hub acceleration is performed by interposing a one-way overruning device between an axle and the hub which initiates rotation of the hub during movement from the rest position to the strap feeding position and which overruns in the strap feeding position.

4. The method of claim 1 in which the step of hub deceleration is performed by supporting the hub from a frame by a pivotally mounted, horizontally movable arm; and positively coupling said hub to said arm in response to termination of strap demand while permitting the hub to rotate about the point of mounting between said arm and said frame, whereby said hub is raised from the strap feeding position to the rest position.

5. A method for dispensing strap from a coil comprising: providing a coil of strap; positioning and supporting said coil in a rest position at an elevated horizontal plane; sensing demand for strap; permitting the coil to fall from said elevated plane to a strap feeding position to a lower plane in response to demand for strap to accelerate said coil, whereby strap is dispensed and rotational energy is developed in the coil; positively terminating rotation of the coil when strap demand is terminated; converting said rotational energy into a force directed vertically upward to cause said coil to move vertically from said lower elevation and to dissipate said rotational energy in the form of work in moving therefrom to an equilibrium elevation; and supporting of the coil at said equilibrium elevation preparatory to repetition of the method.

6. A strap dispenser comprising: frame means; a hub having a coil of strap thereon; means mounting said hub on said frame means for movement between an elevated rest position and a lowered strap feeding position; latch means for retaining said hub in said rest position; strap sensing means for releasing said latch means in response to demand for strap and enabling said hub to fall toward said strap feeding position; means for accelerating said hub in response to the falling movement thereof; said strap sensing means re-engaging said latch means in the absence of demand for strap, whereby the rotational energy of said hub lifts the same from said strap feeding position to said rest position.

7. A strap dispenser as set forth in claim 6 in which said mounting means includes independently rotatable inner and outer axles mounted coaxially of said coil, and wherein said hub accelerating means includes one-way overrunning means connecting said outer axle to said hub; said latch means releasably coupling said inner axle to said hub.

8. A strap dispenser as set forth in claim 7 in which said inner axle is a hollow shaft, and wherein said latch means includes a connection member mounted for movement outwardly of said shaft, at least one abutment on said hub adapted to be engaged by said connection member to releasably couple said inner axle to said hub, and actuating means movable axially of said shaft for moving said connection member outwardly into engagement with said abutment.

9. A strap dispenser as set forth in claim 8 in which said connection member is mounted for movement radially of said shaft, and wherein the engagement surfaces of said connection member and said abutment are complementarily inclined, whereby a component of the weight of said hub is directed radially inwardly of said shaft when said connection member is in engagement with said abutment.

10. A strap dispenser as set forth in claim 8 wherein said connection member has an inwardly facing reaction surface thereon, and wherein said actuating means includes a reaction member engaging said reaction surface and cam means movable axially of said shaft and having a cam profile in engagement with said reaction member.

11. A strap dispenser as set forth in claim 10 in which a plurality of abutments are provided at equally circumferentially spaced positions around said hub, and wherein a pair of radially movable connection members are provided at diametrically opposed positions on said shaft, said connection members each having an inwardly facing reaction surface, there being a reaction member in engagement with each reaction surface and with a cam profile on said cam means.

12. A strap dispenser as set forth in claim 11 in which each cam profile includes a rectilinear surface having a recess therein, and wherein the reaction surfaces on said connection member are parallel with said rectilinear surfaces, said reaction members being rollers movable within said recesses to disengage said connection members and said abutments.

13. A strap dispenser as set forth in claim 11 in which said cam means includes a cam member having a cam profile on opposite sides thereof, each profile including a pair of axially spaced rectilinear surfaces each having a pair of recesses therein, and wherein the rectilinear surfaces and recesses on opposite sides of said cam member are aligned with one another.

14. A strap dispenser as set forth in claim 12 in which said cam means includes a cam member having a cam profile on opposite sides thereof, each profile including a pair of axially spaced rectilinear surfaces each having a pair of recesses therein.

15. A strap dispenser as set forth in claim 14 wherein the rectilinear surfaces and recesses on opposite sides of said cam member are aligned with one another.

16. A strap dispenser as set forth in claim 11 in which said cam profile includes a rectilinear surface having a recess therein, and wherein said reaction member is a roller movable within said recess to disengage said connection member and said abutment.

17. A strap dispenser as set forth in claim 16 in which a guide member is positioned in said shaft adjacent said cam means, said guide means having a slot therein, and wherein said roller has a follower pin positioned within said slot.

18. A strap dispenser as set forth in claim 17 in which first and second shifter elements are positioned in said shaft, each shifter element engaging one end of said cam means.

19. A strap dispenser comprising: a hub having a coil of strap thereon; axle means centrally of said coil of strap and including coaxially arranged inner and outer axles; frame means for supporting said hub and including a horizontal guideway and a vertical guideway; means mountng said hub on said frame means and including bearing means on said axle means and received in said vertical guideway to mount said hub for vertical movement relative to said frame means, said mounting means further including a first member connected to said inner axle and supported upon said horizontal guideway and a second member connected to said outer axle and supported upon said horizontal guideway, said first and second members being constrained for movement between a rest position where said bearing means is disposed at a raised position in said vertical guideway and a strap feeding position where said bearing means is disposed at a lowered position in said vertical guideway; one-way overrunning means for preventing said hub from rotating relative to said outer axle in said rest position and permitting said hub to rotate relative to said outer axle in said strap feeding position; releasable coupling means for preventing said hub from rotating relative to said inner axle in said rest position; and control means for (1) disengaging said releasable coupling means when demand for strap occurs, whereby said hub and axle means falls from said rest position to said strap feeding position, said one-way overrunning means remaining engaged during movement of said hub and axle means from said rest position to said strap feeding position to accelerate said hub, said hub overrunning said outer axle in said strap feeding position, and (2) engaging said releasable coupling means when demand for strap terminates so that the rotational energy of said hub lifts said hub and axle means from said strap feeding position to said rest position, whereupon said one-way overrunning means and said releasable coupling means cooperate to hold said hub and axle means against movement until demand for strap again occurs.

20. A strap dispenser as set forth in claim 19 in which said frame means includes a vertical guideway at opposite sides thereof, and wherein said bearing means includes bearing members at opposite ends of said inner axle.

21. A strap dispenser as set forth in claim 19 in which said first member is an arm connected at one end to said inner axle and including a roller at its opposite end supported upon said horizontal guideway, and wherein said second member is an arm connected at one end to said outer axle and including a roller at its opposite end supported upon said horizontal guideway.

22. A strap dispenser as set forth in claim 19 in which said inner axle is a hollow shaft, and wherein said releasable coupling means includes a connection member mounted for movement outwardly of said shaft, at least one abutment on said hub adapted to be engaged by said connection member to releasably couple said inner axle to said hub, and actuating means movable axially of said shaft for moving said connection member outwardly into engagement with said abutment.

23. A strap dispenser as set forth in claim 22 in which said connection member is mounted for movement radially of said shaft, and wherein the engagement surfaces of said connection member and said abutment are complementarily inclined, whereby a component of the weight of said hub is directed radially inwardly of said shaft when said connection member is in engagement with said abutment.

24. A strap dispenser as set forth in claim 23 in which a plurality of abutments are provided at equally circumferentially spaced positions around said hub, and wherein a pair of radially movable connection members are provided at diametrically opposed positions on said shaft.

25. A strap dispenser as set forth in claim 22 in which said connection member has an inwardly facing reaction surface thereon, and wherein said actuating means includes a reaction member engaging said reaction surface and cam means movable axially of said shaft and having a cam profile in engagement with said reaction member.

26. A strap dispenser as set forth in claim 25 in which said cam profile includes a rectilinear surface having a recess therein, and wherein said reaction member is a roller movable within said recess to disengage said connection member and said abutment.

27. A strap dispenser as set forth in claim 26 in which a guide member is positioned in said shaft adjacent said cam means, said guide member having a slot therein, and wherein said roller has a follower pin positioned within said slot.

28. Apparatus for dispensing strap from a coil mounted thereon comprising: frame means including horizontal support channels adapted to support said coil from either side with its axis in a horizontal plane and vertical guide means extending downwardly from said channels and defining a vertical path; axle means including inner and outer axles rotatably mounted in coaxial relationship therebetween; support means fixedly attached to the ends of said inner and outer axles and engaging said support channels to support said axles therefrom and to move horizontally thereon; bearing means attached to said axle means and engaging said guide means thereby to confine said axle means to said vertical path; hub means for mounting said coil for conjoint rotation therewith; one-way overrunning means mounting said hub means to said outer axle, said one-way overrunning means being rotatable in the direction of coil dispensing; means for interlocking said inner axle and said hub means, whereby said hub will move downwardly relative to said vertical path and rotate in the dispensing direction to unwind said coil after said interlocking means has been disengaged, and said hub means will move upwardly relative to said vertical path and dissipate the rotational energy of said hub in moving itself to an equilibrium position when the interlocking means is engaged, and said hub will be held in said equilibrium position by the action of said interlocking means and one-way overrunning means.

29. Apparatus as set forth in claim 28 wherein said interlocking means includes keys located in said inner axle and inserts complementarily disposed from said hub, said keys and inserts being adapted to direct a component of the coils weight radially to the axle means.

30. Apparatus as set forth in claim 28 wherein said horizontal support channels form a three-sided channel opening inwardly relative to the coil mounted therebetween, said channels being formed with a lower bearing surface from which said support means are supported and an upper horizontal member adapted to confine said engaging support means in the channel as the hub moves upwardly relative to said vertical path.

31. Apparatus as set forth in claim 28 including means for securing a coil to said hub means and comprising a plurality of coil gripping members mounted for movement radially of said hub and adapted to engage said coil for conjoint movement therewith; means for moving said gripping members inwardly and outwardly; and means for simultaneously operating said moving means.

32. A method of dispensing strap from a coil of strap comprising: sensing demand for strap; applying stored energy to said coil to initiate coil rotation and to dispense strap from said coil; sensing termination of strap demand; transforming the rotational energy of the coil into storable energy; and storing said storable energy for subsequent use in initiating subsequent coil rotation.

33. A method of dispensing strap from a coil of strap comprising: positioning said coil for rotation about an axis in a horizontal plane; sensing demand for strap; applying stored energy to said coil by moving said coil from an elevated rest position to a lowered strap dispensing position to initiate coil rotation and to dispense strap from said coil; sensing termination of strap demand; transforming the rotational energy of the coil into storable energy; and storing said storable energy for subsequent use in initiating subsequent coil rotation by moving said coil from said lowered position to an elevated position.

34. The method of claim 33 in which said coil is moved to an elevated position by converting rotational energy of said coil into a vertical lifting force.

* * * * *